US005391215A

United States Patent [19]

Kobayashi et al.

[11] Patent Number: 5,391,215

[45] Date of Patent: Feb. 21, 1995

[54] METHOD FOR PRODUCING HIGH-PURITY METALLIC CHROMIUM

[75] Inventors: Kenichi Kobayashi, Yamagata; Tatsuhiko Fujinuma, Nihonbashi, both of Japan

[73] Assignee: Japan Metals & Chemicals Co., Ltd., Tokyo, Japan

[21] Appl. No.: 923,456

[22] Filed: Aug. 3, 1992

[51] Int. Cl.[6] ..... C22B 34/32

[52] U.S. Cl. ..... 75/623

[58] Field of Search ..... 75/623, 369; 148/423, 148/513

[56] References Cited

U.S. PATENT DOCUMENTS

| | | | |
|---|---|---|---|
| 2,834,671 | 5/1958 | Nachtman et al. | 75/10.65 |
| 2,850,378 | 9/1958 | Cooper | 75/623 |
| 2,939,784 | 6/1960 | Brennan et al. | 75/623 |
| 3,502,461 | 3/1970 | Güttler et al. | 75/10.39 |
| 3,794,482 | 2/1974 | Anderson et al. | 75/397 |
| 3,945,863 | 3/1976 | Precht | 419/23 |
| 4,662,939 | 5/1987 | Reinshagen | 75/246 |
| 4,722,826 | 2/1988 | Poole | 419/11 |
| 5,092,921 | 5/1992 | Kobayashi et al. | 75/623 |

FOREIGN PATENT DOCUMENTS

| | | |
|---|---|---|
| 3-79412 | 4/1991 | Japan . |
| 4-160124 | 6/1992 | Japan . |

*Primary Examiner*—Donald P. Walsh
*Assistant Examiner*—Ngoclan T. Mai
*Attorney, Agent, or Firm*—Oliff & Berridge

[57] ABSTRACT

There is proposed a novel method for manufacturing high-purity metallic chromium that can eliminate the problems of reduced heating capability of the furnace, contamination of produced metallic chromium and other disadvantages related to the operation of the furnace. According to the invention, one or more than one of easily sulfidable metals selected from Sn, Ni and Cu are added to crude metallic chromium containing impurities and the mixture is loaded into a vacuum furnace equipped with heating elements of graphite and heated to 1,200° to 1,500° C. in an atmosphere with reduced pressure of between 0.1 and 5 torr.

10 Claims, 3 Drawing Sheets

METHOD FOR PRODUCING HIGH-PURITY METALLIC CHROMIUM

BACKGROUND OF THE INVENTION

This invention relates to a method for producing high-purity metallic chromium and, particularly, it relates to a method for producing metallic chromium with a very low concentration level of impurities such as sulfur, nitrogen and oxygen. Such high-purity metallic chromium can be suitably used as a raw material for the electronic industry as well as for the industry of producing corrosion-resistive and heat-resistive alloys (super alloys).

Known methods for producing metallic chromium include the electrolytic method that decomposes $Cr_2(SO_4)_3$ by electricity and the alumino-thermite reduction method that reduces $Cr_2O_3$. However, metallic chromium obtained by any of these known methods contains S, O and N at a relatively high level and, therefore, is not good for manufacturing electronic products.

More specifically, said electrolytic method uses $Cr_2(SO_4)_3$ as electrolyte and, therefore, the resultant metallic chromium contains S at a relatively high level of concentration between 200 and 300 ppm and contains O at a level between 3,000 and 10,000 ppm and N between 200 and 500 ppm because of the use of aqueous electrolyte.

On the other hand, metallic chromium obtained by the thermite reduction method contains S at a level of concentration as high as between 200 and 400 ppm because of the fact that sulfuric acid is used for production of $Cr_2O_3$ to be used as the source material and that almost all the sulfur contained in the source material remains in the resultant metallic chromium. While the O content can be decreased by increasing the rate of reducing agent (aluminum) to be added to the source material, this in turn causes the aluminum to remain in the resultant metallic chromium at a high concentration level. If the rate of the use of aluminum should be reduced, the O concentration level of the obtained metallic chromium becomes inevitably as high as 1,000 to 4,000 ppm. The N concentration level will also be as high as approximately 200 ppm.

Since metallic chromium produced by any of the known methods contains S, O and N at a relatively high concentration level, these impurities should be thoroughly removed from the metallic chromium if it be suitably used for its applications.

The vacuum carbon reduction method and the hydrogen reduction method are among the known methods for degassing metallic chromium. With the vacuum carbon reduction method, carbon powder is added to powdered crude metallic chromium and the mixture is then heated in vacuum to remove the oxygen contained in the metallic chromium after turning it into CO. The hydrogen reduction method is, on the other hand, a method of degassing metallic chromium by heating powdered metallic chromium in an atmosphere of hydrogen and causing the oxygen contained in it to change to $H_2O$.

However, any of the above described known methods cannot meet the requirement of manufacturing high-purity metallic chromium which is needed for highly advanced electronic products.

In view of these circumstances, one of the inventors of the present invention has proposed a method for manufacturing high-purity metallic chromium with a very low concentration level of impurities such as S, O and N as disclosed in Japanese Patent Publication No. 3-79412. The proposed method in fact consists in combining a method of heating in vacuum powder of crude metallic chromium with that of easily sulfidable metals such as Sn, Ni and Cu and the vacuum carbon reduction method or the hydrogen reduction method as described above.

It has been proved that the proposed method is very effective in manufacturing high-purity metallic chromium with a very low concentration level of impurities and, therefore, can be suitably used for various applications including those described above.

However, since the proposed method requires a high degree of vacuum and elevated temperature for heat treatment of crude metallic chromium in vacuum, it inevitably entails a problem of sublimated metallic chromium, which eventually adheres to the heating elements and the lining of furnace to damage the furnace and reduce its heat treatment capacity so that consequently the capability of the furnace to produce high-purity metallic chromium on a stable basis may be significantly adversely affected. There may also arise a problem of contamination of produced metallic chromium by the metallic material of the heating elements of furnace if the heating elements are made of metal. Additionally, there may also be a problem of malfunction of furnace due to prolonged furnace operation involving vacuum and high temperature in an attempt to reduce the concentration level of impurities in the produced metallic chromium as low as possible.

SUMMARY OF THE INVENTION

It is therefore an object of the present invention to provide a method as well as apparatus for manufacturing high-purity metallic chromium that can solve the above described problems of deteriorated heat treatment capacity, production of contaminated metallic chromium and furnace malfunction.

As a result of intensive research efforts, the inventors of the present invention have proposed a method for manufacturing high-purity metallic chromium which is free from the above described problems.

According to the present invention, there is provided a method for manufacturing high-purity metallic chromium comprising steps of mixing powdered metallic chromium containing impurities with powder of one or more than one easily sulfidable metals selected from Sn, Ni and Cu and subjecting the mixture to a heat treatment process in vacuum, said heat treatment process being conducted at a temperature between 1,200° and 1,500° C. and pressure between 0.1 and 5 torr in a vacuum furnace equipped with heating elements of graphite.

For the purpose of the present invention, carbon powder may be advantageously added to said mixture.

A binding agent may be advantageously added to said mixture to form briquettes of the mixture, which are then subjected to a heat treatment process.

For the purpose of the present invention, the volume of carbon powder to be added to said briquetted mixture needs to be such that the ratio of said volume of carbon powder to the stoichiometric volume of carbon for reducing the oxygen in the crude metallic chromium is found between 0.9 and 1.1. On the other hand, the volume of powder of the easily sulfidable metals in said mixture is preferably such that the ratio of said volume to the stoichiometric volume of easily sulfidable metals for removing the sulfur in the crude metallic chromium is also found between 0.9 and 1.1.

According to the present invention, there is also provided an apparatus for manufacturing high-purity metallic chromium comprising a container made of graphite for containing a mixture of powdered metallic chromium, easily sulfidable metals and carbon powder, a thermally insulating box provided in its inside with heating elements made of graphite and a lining made of carbon for receiving said container and a vacuum furnace made of steel and provided with a lid for sealingly containing said thermally insulating box and said graphite container.

With a method and an apparatus for manufacturing high-purity metallic chromium according to the invention, high-purity metallic chromium which is free from impurities such as S, O and N that inevitably contaminate refined metallic chromium if an ordinary method is used can be produced in an effective and efficient manner.

DESCRIPTION OF THE PREFERRED EMBODIMENTS

Crude metallic chromium which is the starting raw material to be treated for the purpose of the invention may be prepared by means of an electrolytic method, an alumino-thermite method or a carbon reduction method. The prepared crude metallic chromium is preferably crushed to particles of 100 mesh or less in order to provide a good contact between the impurities contained in the crude metallic chromium and the additive to be added to the crude metallic chromium and clean the crude chromium as neatly as possible.

For the purpose of the present invention, powder of at least one of easily sulfidable metals selected from Sn, Ni and Cu may be advantageously added with carbon powder to powdered crude metallic chromium to form a mixture thereof.

Powder of one or more than one easily sulfidable metals is added to crude metallic chromium in order to remove the sulfur content of the crude metallic chromium. These metals easily react with sulfur to produce sulfides of the metals, which can be easily volatilized and removed when heated under reduced pressure because of its relatively high specific vapor pressure.

Figure 1:
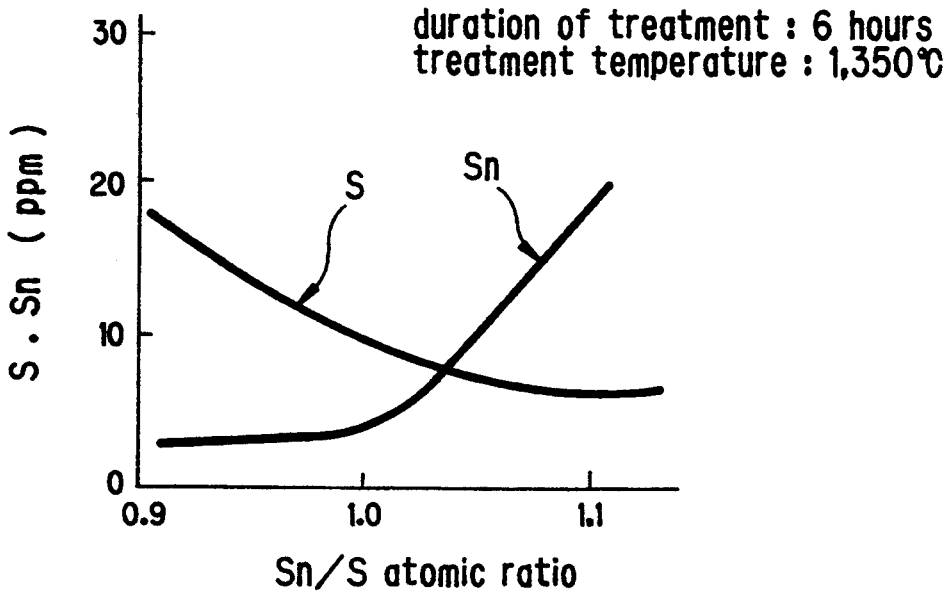
FIG. 1 is a graph showing the effect of Sn added to crude metallic chromium for removing S in the latter.

The volume of powder of easily sulfidable metals to be added to crude metallic chromium is preferably such that the ratio of said volume to the stoichiometric volume of easily sulfidable metals for removing the sulfur in the crude metallic chromium is found between 0.9 and 1.1. The reason for this is that, if the ratio is smaller than 0.9, the sulfur in the crude metallic chromium will be poorly removed whereas, if the ratio is greater than 1.1, the residual easily sulfidable metals in the crude metallic chromium will be significant after removing the sulfur content so that the purity of the refined metallic chromium product will be rather poor. The graph of FIG. 1 shows the effect of Sn added to crude metallic chromium for removing S in the latter and it will be seen from the graph that S is effectively removed if the ratio of Sn/S is found within the above defined range.

Figure 2:
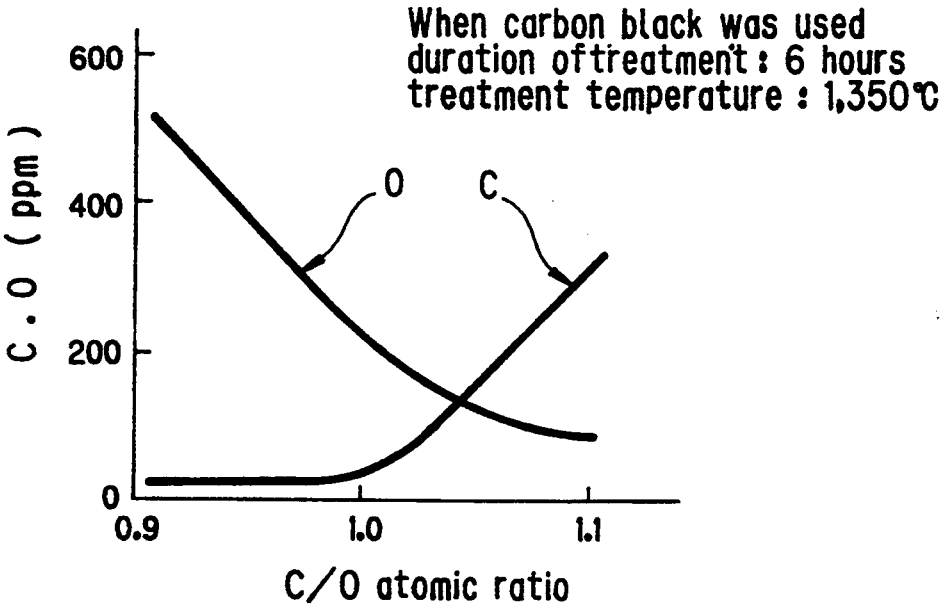
FIG. 2 is a graph showing the effect of C added to crude metallic chromium for removing O in the latter.

Carbon powder to be used with or in place of easily sulfidable metals for removing a relatively small amount of oxygen contained in crude metallic chromium for the purpose of the present invention may be replaced by chromium carbide as proposed earlier by the inventors of the present invention. (See Japanese Patent Laid-Open Publication No. 4-160124). The reason for using carbon is that oxygen in crude metallic chromium can be turned to CO gas through reaction of oxygen in crude metallic chromium and carbon powder if the mixture of crude metallic chromium and carbon powder is heated under reduced pressure and the produced CO gas can be removed by dissipating it from the reaction system. The volume of carbon powder to be added to said briquetted mixture needs to be such that the ratio of said volume of carbon powder to the stoichiometric volume of carbon for reducing the oxygen in the crude metallic chromium is found between 0.9 and 1.1. The reason for this is that, if the ratio is smaller than 0.9, the oxygen in the crude metallic chromium will be poorly removed whereas, if the ratio is greater than 1.1, the residual carbon powder in the crude metallic chromium will be significant after removing the oxygen content so that the purity of the refined metallic chromium product will be rather poor. This will also be understood from the graph of FIG. 2.

For the purpose of the present invention, said mixture is heated under reduced pressure. Said mixture may be heated as it is or, alternatively, it may be molded after adding a binding agent thereto. Possible modes of molding may include briquetting and pelletizing. While no specific requirements need to be defined for molded pieces of crude metallic chromium in terms of shape and size, each molded piece of crude metallic chromium may preferably have a form that permits easy handling for subsequent operations. While water may be used as a binding agent to be used for the purpose of the invention, an organic binding agent such as polyvinyl alcohol can be more advantageously used.

When the powder is molded into briquettes by using a binder agent, they are preferably dried at a temperature that does not cause oxidization of metallic chromium prior to the process of depressurization and heat-treatment.

Figure 4A:
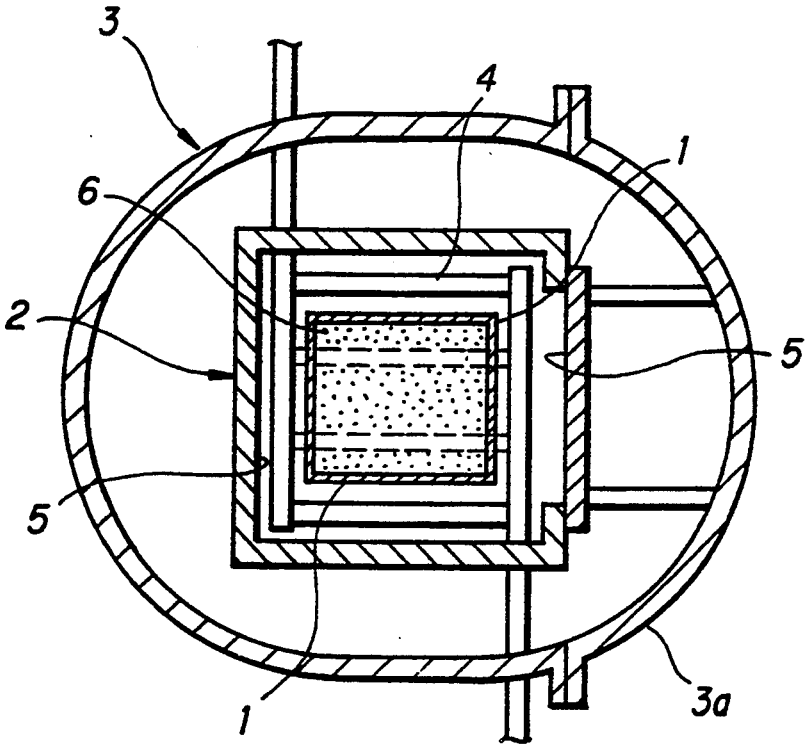
FIG. 4 shows two sectional views of an embodiment of the apparatus for manufacturing high-purity metallic chromium according to the invention.
Figure 4B:
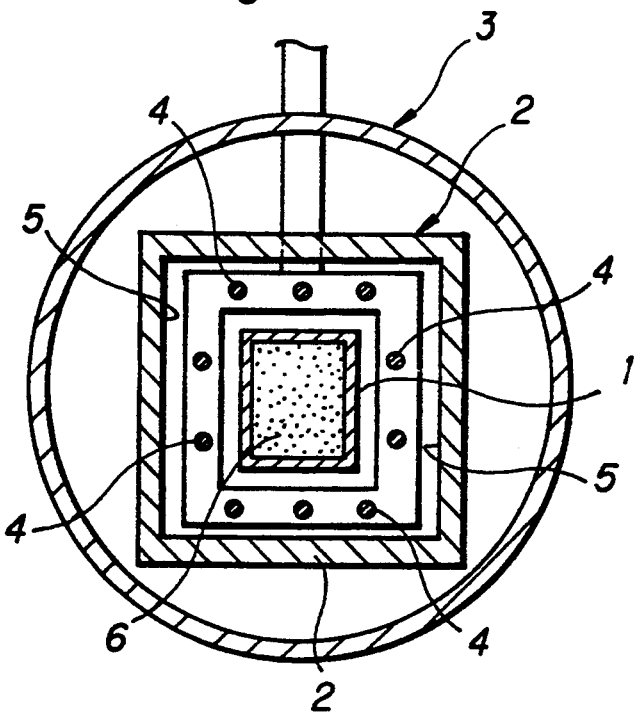

For the above described heat treatment to be conducted for the purpose of the present invention, a vacuum furnace as illustrated in (a) and (b) of FIG. 4 will be used. The vacuum furnace principally comprises a container 1 made of graphite, a thermally insulating box 2 that surrounds the container 1 and a vacuum furnace 3 provided with a lid for containing said thermally insulating box 2.

Said powdered or molded mixture 6 is placed in said graphite container 1. Said thermally insulating box 2 is equipped with a number of heating elements 4 made of graphite which are disposed within said box 2 and provided with a lining 5 made of carbon. Said vacuum furnace 3 is made of steel and provided with a lid 3*a* for sealingly enclosing the contents.

The reason for using graphite-made heating elements 4 disposed within said box 2 is that, if heating elements that are made of a metal, an oxide or a non-metal material such as SiC are used, vapor of chromium volatilized from metallic chromium during the heat treatment process in vacuum can be deposited on the heating elements to damage and degrade them until they become non-operational for prolonged or repetitive use and also the produced metallic chromium is contaminated by the vaporized component from heating elements.

If, on the other hand, such heating elements are used with low temperature and a reduced degree of vacuum in order to avoid the above problems, the time required for the overall reaction will be significantly prolonged. On the contrary, heating elements made of graphite are free from the problems of degradation due to vapor deposition, volatilization of the material of the heating elements and, therefore, contamination of the produced metallic chromium.

The above described heat treatment process is conducted in vacuum by loading a mixture of powdered crude metallic chromium, powder of one or more than one of easily sulfidable metals selected from Sn, Ni and Cu and carbon powder or briquettes thereof into said graphite container 1, placing said graphite container 1 in the thermally insulating box 2 equipped with graphite heating elements 4, closing the lid 3*a* of the vacuum furnace 3 and heating the mixture under reduced pressure.

The temperature and the pressure of the heat treatment needs to be respectively between 1,200° and 1,500° C. and between 0.1 and 5 torr. The reaction proceeds too slow and insufficient desulfurization and deoxidization of the reaction system will result if the temperature is below 1,200° C. On the other hand, the loss of chromium will become remarkable due to volatilization if the temperature is above 1,500° C. The loss of chromium will also be remarkable due to volatilization if the pressure is below 0.1 torr, whereas insufficient desulfurization and deoxidization will take place if the pressure is above 5 torr.

While the reaction may proceed considerably well under reduced pressure regardless of the type of atmosphere, it will be carried out more satisfactorily if it is conducted in an atmosphere of inert gas having a reduced pressure because the inert gas acts as carrier gas that enhances the mobility of the gas generated in the reaction system by heat treatment.

Figure 3:
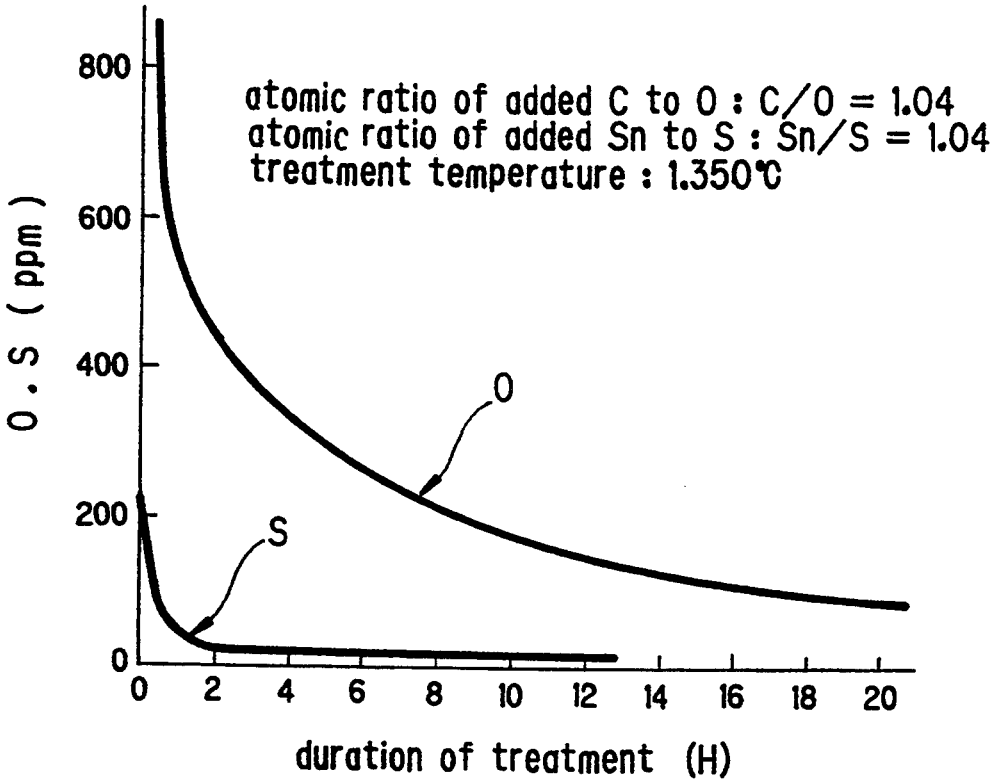
FIG. 3 is a graph showing the effect of duration of heat treatment of crude metallic chromium for removing S and O in the latter.

While the duration of the heat treatment with the above described temperature range cannot be specifically defined because it is a function of certain variables including the volume of easily sulfidable metals, that of carbon powder and the pressure and temperature of the reaction system, 6 to 10 hours will be reasonable, although the reaction terminates an active phase in approximately 2 hours as typically illustrated in FIG. 3. As a matter of course, the heat treatment can be maintained for a more prolonged period of time and the volume of O and S will be reduced gradually in proportion to the actual duration of heat treatment.

EXAMPLE 1

Crude metallic chromium was crushed to particles of 100 mesh or less by means of a top grinder and powdered Sn and C were added to and mixed with the obtained powder of crude metallic chromium. The volume of Sn powder was so determined that its ratio to the stoichiometric volume of Sn required to change the entire S contained in the crude metallic chromium to SnS was 1.04. Similarly, the volume of C powder was so determined that its ratio to the stoichiometric volume of C required to change the entire O contained in the crude metallic chromium to CO was 1.04.

A small amount of PVA (5%) solution was added to the mixture as a binder agent and the mixture was then briquetted and dried at 130° C. for approximately 8 hours.

The obtained briquettes were then loaded into a box-shaped graphite container, which was then placed in a vacuum furnace provided in the inside with heating elements of graphite and having a thermally insulating box in it, said box being lined by a sheet of graphite. The lid of the furnace was hermetically closed and the inside of the furnace was evacuated. Thereafter, the furnace was heated while maintaining the evacuated condition of the inside to approximately 2 torr and causing argon gas to incessantly circulate there. As soon as the inside of the furnace reached a predetermined temperature, the inside pressure was gradually reduced until it finally became equal to 0.1 torr.

The argon gas was made to circulate well after the end of the heat treatment until the temperature fell below 200° C. After the inside of the furnace was sufficiently cooled, the reaction product was taken out of the container and subjected to a chemical analysis. Thereafter, a number of similar experiments and analytic operations were conducted. Table 1 shows the results of the experiments in terms of the concentration levels of impurities contained in the crude metallic chromium, the conditions of heat treatment and the concentration levels of impurities contained in the refined metallic chromium.

TABLE 1

| No. of | crude metalic chromium (ppm) | | | | | treatment conditions | | refined metallic chromium (ppm) | | | | |
|---|---|---|---|---|---|---|---|---|---|---|---|---|
| exp. | C | S | O | N | Sn | temp. | time | C | S | O | N | Sn |
| 1 | 115 | 234 | 6100 | 45 | <1 | 1340 | 4 | 120 | 28 | 350 | <10 | 11 |
| 2 | " | " | " | " | " | " | 6 | 80 | 12 | 240 | <10 | 5 |
| 3 | " | " | " | " | " | " | 8 | 50 | 7 | 180 | <10 | 7 |
| 4 | " | " | " | " | " | " | 10 | 50 | 5 | 170 | <10 | 9 |
| 5 | " | " | " | " | " | " | 14 | 30 | 4 | 100 | <10 | 5 |
| 6 | " | " | " | " | " | " | 20 | 20 | 5 | 120 | <10 | 5 |
| 7 | 103 | 227 | 5400 | 430 | <1 | 1250 | 6 | 70 | 15 | 270 | 60 | 7 |
| 8 | " | " | " | " | " | 1350 | 6 | 50 | 8 | 250 | 20 | 7 |
| 9 | " | " | " | " | " | 1450 | 6 | 50 | 10 | 210 | 30 | 9 |
| 10 | 125 | 187 | 6200 | 307 | <1 | 1350 | 6 | 60 | 7 | 250 | 10 | 5 |
| 11 | " | " | " | " | " | " | 6 | 80 | 7 | 270 | 20 | 6 |
| 12 | " | " | " | " | " | " | 6 | 80 | 6 | 280 | 20 | 5 |

[Note]
Unit; temp. = °C., time = hours

EXAMPLE 2

Briquettes containing mainly crude metallic chromium and prepared in a manner similar as those of Example 1 above were subjected to a series of heat treatments conducted at 1,350° C. for 30 times, each lasted in average for 8 hours. It was found after the experiment that the vacuum furnace used for the experiment was totally free from damage and could be used for continuous operations. It was also found that the obtained refined metallic chromium was highly pure and contained O, S and N to respective concentration levels of approximately 200 ppm. less than 10 ppm and less than 10 ppm.

EFFECTS

As is apparent from the above description, a method for manufacturing high-purity metallic chromium according to the invention is advantageous in that the produced metallic chromium is free from contamination and it does not involve any reduction in the capacity of refining crude metallic chromium and the service life of vacuum furnace so that it can produce high-purity metallic chromium effectively and efficiently.

What is claimed is;

1. A method for manufacturing high-purity metallic chromium having reduced levels of sulfur and nitrogen, comprising steps of mixing powdered crude metallic chromium containing impurities with powder of one or more than one easily sulfidable metals selected from Sn, Ni and Cu and subjecting the mixture to a heat treatment process in vacuum, said heat treatment process being conducted at a temperature between 1,200° and 1,500° C. and pressure between 0.1 and 5 torr in a vacuum furnace equipped with heating elements of graphite.

2. A method for manufacturing high-purity metallic chromium according to claim 1, wherein a binding agent is added to said mixture to form briquettes of the mixture, said briquettes being subsequently subjected to a heat treatment process.

3. A method for manufacturing high-purity metallic chromium according to claim 1, wherein the easily sulfidable metals are added in said mixture in an amount such that a ratio of said amount to a stoichiometric amount of easily sulfidable metals for reacting with the sulfur in the crude metallic chromium to metal sulfide is between 0.9 and 1.1.

4. A method of manufacturing high-purity metallic chromium according to claim 1, wherein the high-purity metallic chromium contains less than 10 ppm of sulfur, less than 10 ppm of nitrogen, and about 200 ppm of oxygen.

5. A method for manufacturing high-purity metallic chromium having reduced concentration levels of sulfur, nitrogen and oxygen, comprising steps of mixing powdered crude metallic chromium containing impurities with carbon powder and powder of one or more than one easily sulfidable metals selected from tin, nickel and copper and subjecting the mixture to a heat treatment process in vacuum, said heat treatment process being conducted at a temperature between 1,200° and 1,500° C. and pressure between 0.1 and 5 torr in a vacuum furnace equipped with heating elements of graphite.

6. A method for manufacturing high-purity metallic chromium according to claim 5, wherein a binding agent is added to said mixture to form briquettes of the mixture, said briquettes being subsequently subjected to a heat treatment process.

7. A method for manufacturing high-purity metallic chromium according to claim 5, wherein the easily sulfidable metals are added in said mixture in an amount such that a ratio of said amount to a stoichiometric amount of easily sulfidable metals for reacting with the sulfur in the crude metallic chromium to metal sulfide is between 0.9 and 1.1.

8. A method for manufacturing high-purity metallic chromium according to claim 5, wherein the carbon powder is added to said mixture in an amount such that a ratio of said amount of carbon powder to a stoichiometric amount of carbon for reacting with the oxygen in the crude metallic chromium to carbon monoxide is between 0.9 and 1.1.

9. A method for manufacturing high-purity metallic chromium according to claim 5, wherein the high-purity metallic chromium contains less than 10 ppm of sulfur, less than 10 ppm of nitrogen, and about 200 ppm of oxygen.

10. A method for manufacturing high-purity metallic chromium having reduced levels of sulfur, nitrogen and oxygen, comprising steps of mixing powdered crude metallic chromium containing impurities with chromium carbide powder and powder of one or more than one easily sulfidable metals selected from Sn, Ni and Cu and subjecting the mixture to a heat treatment process in vacuum, said heat treatment process being conducted at a temperature between 1,200° and 1,500° C. and pressure between 0.1 and 5 torr in a vacuum furnace equipped with heating elements of graphite.

* * * * *